United States Patent [19]

Pruitt et al.

[11] Patent Number: 4,873,913

[45] Date of Patent: Oct. 17, 1989

[54] DRY ROUGHING PUMP HAVING A GAS FILM BEARING

[75] Inventors: Gerald R. Pruitt, Mendon; Peter Bertsch, Harvard, both of Mass.

[73] Assignee: Helix Technology Corporation, Waltham, Mass.

[21] Appl. No.: 906,741

[22] Filed: Sep. 12, 1986

[51] Int. Cl.[4] ..... F01B 31/10; F01B 31/00

[52] U.S. Cl. ..... 92/158; 92/159; 92/160; 92/162 R

[58] Field of Search ..... 92/158, 159, 160, 162, 92/155, 154, 170, 171, 153, 248, 163; 417/493, 901

[56] References Cited

U.S. PATENT DOCUMENTS

| | | | |
|---|---|---|---|
| 3,779,672 | 12/1973 | Schroeder | 417/493 |
| 4,446,702 | 5/1984 | Peterson | 417/901 |
| 4,545,738 | 10/1985 | Young | 417/53 |
| 4,574,591 | 3/1986 | Bertsch | 92/170 |

FOREIGN PATENT DOCUMENTS 394740 6/1965 Switzerland .

*Primary Examiner*—Robert E. Garrett
*Assistant Examiner*—Thomas Denion
*Attorney, Agent, or Firm*—Hamilton, Brook, Smith & Reynolds

[57] ABSTRACT

The present invention relates to a cryopump having a gas bearing formed in a clearance seal between a piston and a cylinder. The gas bearing is formed by forcing pressurized gas from a gas plenum through orifices to the clearance seal.

26 Claims, 5 Drawing Sheets

DRY ROUGHING PUMP HAVING A GAS FILM BEARING

BACKGROUND

A typical cryopump system is disclosed in U.S. Pat. No. 4,446,702 to J. Peterson and A. Bartlett. In that system, shown in FIG. 1, a work chamber 10 is maintained at a high vacuum by a cryopump 12. When the system is initially started, however, the work chamber 10 is brought to an intermediate vacuum pressure by a roughing pump 14. The roughing pump 14 also initially pumps down the cryopump 12 to a moderate vacuum. After the work chamber 10 and cryopump 12 have been evacuated to a moderate vacuum pressure, the roughing pump 14 is inactivated.

Additionally, in most operations it is necessary to transfer materials into and out of the high vacuum working space. Conventionally, work material is moved into the high vacuum space by first exposing it to a vacuum load lock or cross over chamber 16. Material is placed in the load lock 16 and this space is evacuated to an intermediate pressure by a roughing pump 14. In this crossover chamber, pressure is typically limited to the limitations of the roughing pump. Roughing pumps used in this system are limited to minimum pressures in the range of 400 millitorrs to minimize the effect of oil backstreaming. Above 400 millitorrs pump pressures keep gas flow in the viscous range. At lower pressures, oil vapor is released from the roughing pumps 14 and enters the work chamber 10 by molecular backstreaming. Thus, if the pressure is too low, oil vapor from the roughing pumps mix with residual gas in the crossover area. The residual gas (which typically consists of a majority of water vapor with lesser amounts of atmospheric gases and possibly oil vapor) in the crossover area is then released into the working space when work material is transferred from the crossover area into the work space. Impurities introduced in such a manner can be detrimental to high vacuum operations such as integrated circuit manufacture.

Presently, impurities are handled by the condensing arrays 18 of the cryopump 12 which maintains the high vacuum environment of the working space. The disadvantage of this method is that processing time is affected. In many cases, work space pressure is increased to a level far too high for the affected manufacturing process to continue. Work must, therefore, cease periodically during the evacuation of the contaminated crossover gas from the work chamber.

In some systems, a second cryopump coupled to the load lock 16 has been used to reduce the crossover pressure and minimize the gas pulse during the transfer of material. Such a system, however, increases the expense and the size of the over-all packaging of the system.

There exists, therefore, a need to eliminate contamination created by the roughing pump while evacuating the work environment and the cryopump to an intermediate vacuum pressure.

SUMMARY OF THE INVENTION

In a cryopump system a dry roughing pump is needed to bring the work environment and the cryopump down to a moderate vacuum. Further services require the roughing pump to depressurize a crossover chamber before a work piece is inserted into the work environment. In order to prevent oil vapor contamination of the work environment, the present invention includes a dry roughing pump comprising a piston linearly displaced within a cylinder and separated by an oil free clearance seal. Preferably, a gas bearing is formed between the piston and the cylinder by forcing pressurized gas from a gas plenum located within the cylinder through orifices to the clearance seal. It is further preferred that two coaxial rows of evenly spaced orifices are positioned within the cylinder adjacent to the piston during operation for communicating pressurized gas from the gas plenum to the clearance seal. Arranging the orifices in this manner avoids contact of the clearance seal surfaces induced by moment forces acting on the piston. To help minimize the gas leakage, a vent may be located in the cylinder adjacent to the piston such that it is in fluid communication with the clearance seal to reduce the pressure differential seen by the vacuum.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 2:
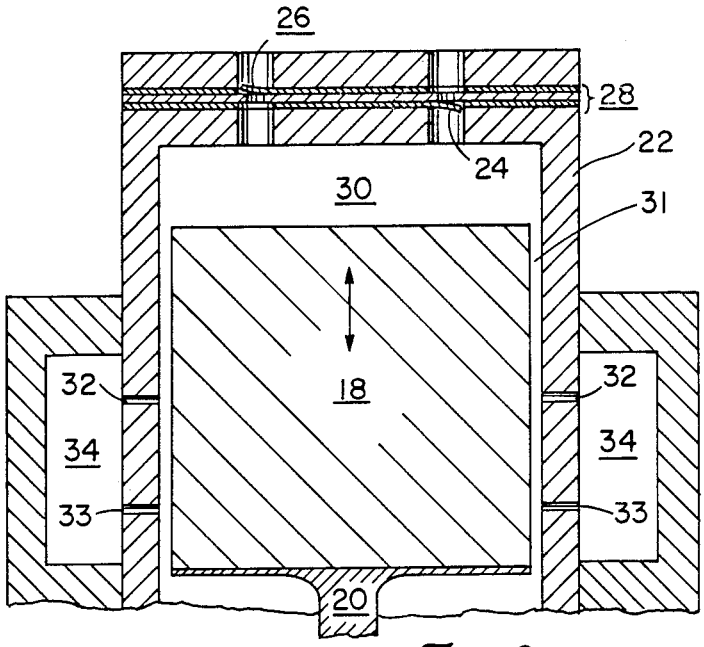
FIG. 2 is a sectional view of a dry roughing pump embodying the invention.

A dry roughing pump embodying this invention is shown in FIG. 2. This pump comprises a piston element 18 which is driven by a drive rod 20 in a linearly reciprocating motion within a cylinder 22.

Figure 1:
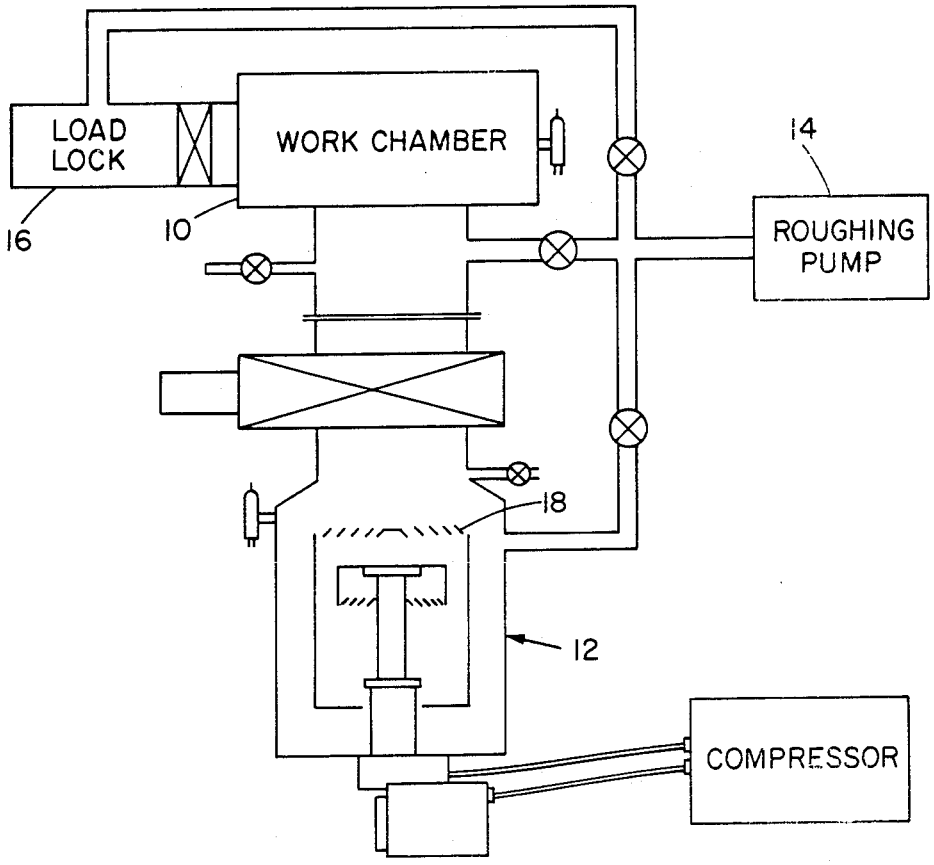
FIG. 1 is a schematic view of a cryopump system.

As the piston element withdraws from the cylinder 22, sufficient vacuum is created to open an intake valve 24 and close an exhaust valve 26 of a reed valve assembly 28 (described below). With continued withdrawal of the piston, gas from the work environment of the cryopump (shown in FIG. 1) is drawn through the intake valve 24 to an evacuated space 30 left by the piston element 18 within the cylinder 22. When the piston reverses its direction, compression of the gas captured in the evacuated space 30 creates sufficient pressure to close the intake valve 24 and open the exhaust valve 26. During full extention of the piston 18, the gas in the evacuated space 30 is exhausted and a new cycle begins.

In the present invention, we have eliminated the oil bearing used in the past for lubrication by replacing this bearing with a clearance seal 31 as shown in FIG. 2. The clearance seal is formed by creating a small gap, such as five ten-thousandths of an inch, between the piston and the cylinder. With such a small gap, vacuum leakage is minimized. A liner of hard material such as ceramic (not shown) may be placed on adjacent surfaces of the clearance seal 31 in order to insure against galling of either the piston or the cylinder during operation. By providing a clearance seal between the piston and the cylinder, the problem of oil vapor associated with conventional pumps has been eliminated.

As depicted in FIG. 2, we have also introduced a gas bearing by supplying pressurized gas from a plenum 34 through orifices 32 and 33 to the clearance seal 31. By properly sizing the orifices 32 and by separating them equally along a concentric row in the cylinder, a controlled amount of pressurized gas can be introduced to create the gas bearing. Preferably when 50–100 psig of pressurized gas is used to supply the hydrostatic bearing, gas consumption is no greater than 100 std. cubic ft/hr for the bearing.

By introducing the gas bearing, contact between the surfaces of the clearance seal can be avoided. If, during operation, the piston 18 were to move toward the cylinder 22, gas pressure between the piston 18 and the cylinder 22 would increase whereby sufficient force would be created to push the piston 18 away from the cylinder 22. Thus, in addition to prolonging the life of the pump by preventing gouging, soft materials such as aluminum may be used to line the clearance seal walls. However, when soft materials are used as a clearance seal liner, it is preferred that pressurized gas be supplied to the clearance seal immediately before and just after operation of the roughing pump. This would prevent unnecessary scoring during start up and shut down of the pump.

In order to create a balancing force to correct any moment force created as the piston shuttles back and forth, a second concentric row of orifices 33 is positioned adjacent to the piston. By increasing the spacing between the rows of orifices the amount of corrective force applied to the piston is increased. Preferably, both rows of orifices are adjacent to the piston during operation.

Any leak created by the introduction of pressurized gas into the cylinder can easily be predetermined and controlled by those skilled in the art. For example, considerations of the maximum pressure need to balance the piston, the vacuum level of the roughing pump, and the gas volume flow are all taken into consideration for determining the size and number of orifices needed in order to minimize the possible vacuum leakage. To prevent any contamination caused by introducing leakage, gas supplying the gas plenum 34 may be supplied by a fixed pressure vessel, a secondary compression piston, or in some cases atmospheric air. In humid environments a dryer could be installed to prevent water vapor from getting into the evacuated space 30.

Figure 3:
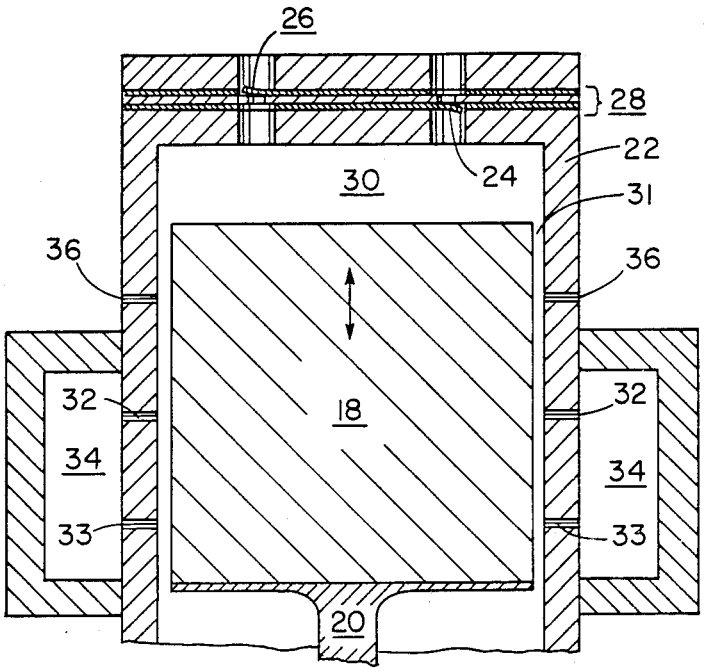
FIG. 3 is a sectional view of an alternative embodiment of this invention.

An alternate embodiment is shown in FIG. 3. As shown, vents 36 in fluid communication with the clearance seal 31 have been introduced. The vents 36 allow the pressurized gas, introduced into the clearance seal 31, to be exhausted to an environment which has a pressure between that of the pressurized gas introduced and that of the evacuated space 30. It is preferred that the vents 36 are located in the cylinder wall between the gas orifices 32 and 33 and the evacuated space 30. It is further preferred that the vents 36 are equally spaced orifices forming a concentric row in the cylinder wall adjacent to the piston 18 during operation. The advantage of the vents is that gas leakage, introduced by the gas bearing, is minimized because the pressure differential seen by the vacuum is reduced.

Figure 4:
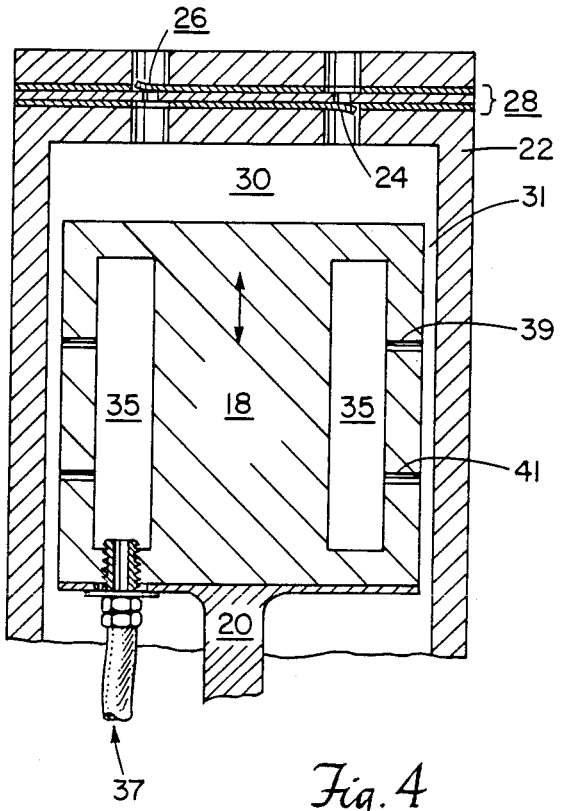
FIG. 4 is a sectional view of a second alternative embodiment of this invention.

In the above embodiments, the plenum 34 is shown exterior to the cylinder 22 and in communication with the clearance seal 31 through orifices 32 and 33. The present invention is not limited to this construction and may for convience of space, locate a plenum 35 within the piston 18 as shown in FIG. 4. Pressurized gas delivered to the plenum 35 by a flexible hose 37 is supplied to the clearance seal 31 through orifices 39 and 41 concentrically along the piston wall.

Figure 5:
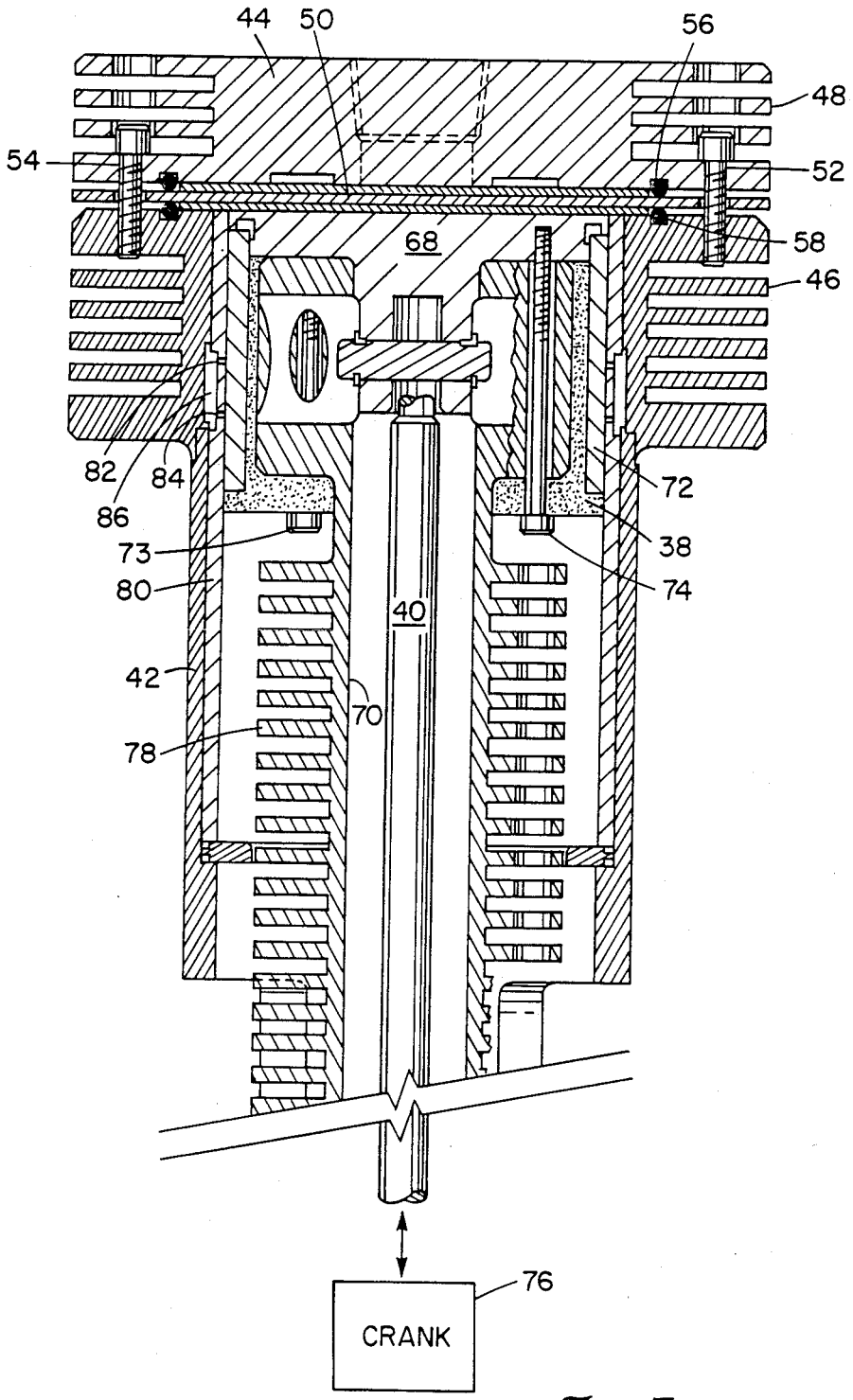
FIG. 5 is a sectional view of a dry roughing pump.

In FIG. 5, a preferred dry roughing pump is shown. This figure shows a piston assembly 38 driven by a drive shaft 40 in a linear reciprocating motion within a cylinder 42. Attached at one end of the cylinder 42 is a cylinder cap 44. Preferably, both the cylinder 42 and the cap 44 have convection fins 46 and 48 and are made of material such as aluminum having high thermal conductivity. Positioned between the cylinder cap 44 and the cylinder 42 is a reed valve assembly 50. The reed valve assembly 50 is held in place by screws 52 and 54 extending through the cylinder cap 44 and reed valve assembly 50 to the cylinder 42. A seal is accomplished by placing O-rings 56 and 58 between the cylinder cap 44 and the cylinder 42.

Figure 6:
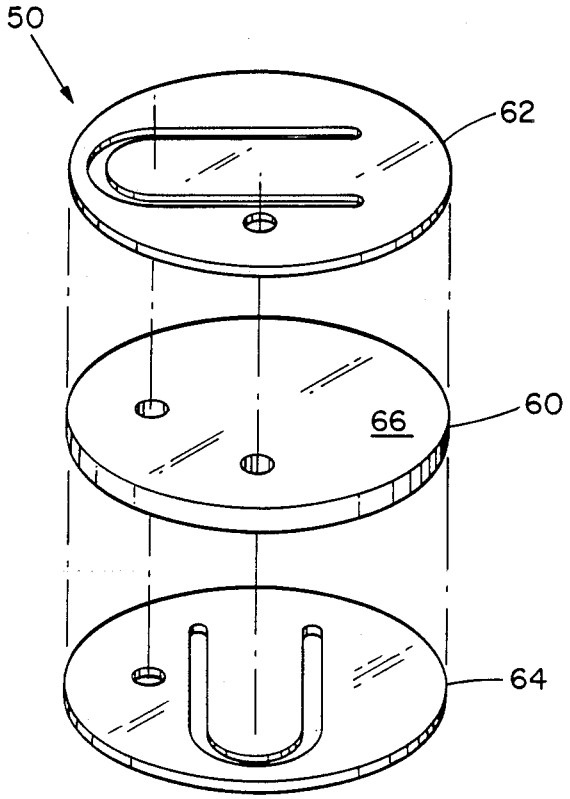
FIG. 6 is an exploded view of the reed valve assembly of the dry roughing pump shown in FIG. 4.

An exploded view of the reed valve is shown in FIG. 6. The reed valve assembly is essentially a solid plate 60 placed between two reed valves 62 and 64. The solid plate 60 is used primarily to provide support for the reeds and to provide a sealing surface 66 against which the reeds press. The reeds 62 and 64 may be cemented in place on the solid plate 60. The function of the reed valve assembly 50 is to provide an intake valve and an exhaust valve as shown in FIGS. 2–4. A different valve arrangement, however, may depend on design judgments. For example, at low pressure differentials, about 1 torr or less, reed valves may not prove to be effective.

The piston assembly 38, adjacent to the reed valve assembly 50, comprises a head portion 68 and a body portion 70 made from a high thermal conductivity material such as aluminum. A piston liner 72 is joined to the head portion 68 adjacent to the cylinder 42. This liner is preferably made from a hard material such as ceramic to prevent scoring if contact between the piston assembly 38 and the cylinder 42 is made. The body portion 70 of the piston assembly is preferably secured to the head portion 68 by screws 73 and 74. The body portion 70 extends substantially along the length of a drive shaft 40 which is used to connect a crank 76 to the piston assembly 38. The exterior perimeter of the body portion 70 supports annular convection fins 78 to help dissipate heat created by the piston during pumping operations.

Adjacent to the piston assembly, a cylinder liner 80 is attached to the cylinder 42. Preferably, the cylinder liner 80, like that of the piston head liner 72, is made from a hard material such as ceramic. The cylinder liner has two concentric rows of gas orifices 82 and 84 positioned so that they are always adjacent to the piston head portion during operation. These orifices communicate to a gas plenum 86 located between the cylinder 42 and the cylinder liner 80. As discussed above, the purpose of the gas plenum 86 is to supply pressurized gas between the piston assembly 38 and the cylinder 42 in order to form a gas bearing. Preferably, 25 to 100 psig of contaminant free gas is supplied to the plenum 86.

A gas bearing system has therefore been shown which permits the construction of a dry roughing pump by providing a clearance seal between the piston and the cylinder. Maintenance of the dry roughing pump has been minimized by introducing a gas bearing within the clearance seal. Manufacturing of the dry roughing pump disclosed above is relatively inexpensive and allows for a very compact gas bearing system which eliminates contaminants, such as oil vapor created by conventional oil lubricated roughing pumps.

While the invention has been particularly shown and described with references to preferred embodiments thereof, it will be understood by those skilled in the art that various changes in the form and detail may be made without departing from the spirit and scope of the invention as described in the appended claims. For example, the crank may be replaced by linear drive coils which when activated drive the piston linearly.

We claim:

1. A vacuum pump assembly coupled to draw a vacuum and comprising a piston assembly positioned for axial movement within a cylinder with an evacuation space at one end thereof and separated from the cylinder by an oil free clearance seal, a source of pressurized gas; said pressurized gas being applied to the clearance seal to provide an air bearing.

2. A vacuum pump assembly as claimed in claim 1, further comprising: (a) multiple orifices which provide fluid communication from the source of pressurized gas to the clearance seal.

3. A vacuum pump assembly as claimed in claim 2 wherein the multiple orifices are located in the cylinder.

4. A vacuum pump assembly as claimed in claim 2 further comprising a vent in the cylinder in fluid communication with the clearance seal between the multiple orifices and the evacuation space.

5. A vacuum pump assembly as claimed in claim 2, wherein two concentric rows of multiple orifices are located within the cylinder to provide fluid communication from the gas source to the clearance seal.

6. A vacuum pump assembly as claimed in claim 5, wherein the orifices in each row are evenly spaced.

7. A vacuum pump assembly as claimed in claim 2, wherein the multiple orifices are located in the piston assembly.

8. A vacuum pump assembly as claimed in claim 2 further comprising a vent in the piston in fluid communication with the clearance seal between the multiple orifices and the evacuation space.

9. A vacuum pump assembly as claimed in claim 2, wherein two concentric rows of multiple orifices are located within the piston to provide fluid communication from the gas source to the clearance seal.

10. A vacuum pump assembly as claimed in claim 9, wherein the orifices in each row are evenly spaced.

11. A vacuum pump assembly as claimed in claim 1, wherein the piston assembly comprises a head portion supporting a ceramic liner and a body portion which supports convection fins.

12. A vacuum pump assembly coupled to draw a vacuum and comprising:

(a) a piston assembly positioned for axial movement within a cylinder with an evacuation space at one end thereof and separated from the cylinder by an oil free clearance seal;

(b) a source of pressurized gas adjacent to the oil free clearance seal; and (c) multiple orifices which provide fluid communication from the source of pressurized gas to the clearance seal.

13. A vacuum pump assembly as claimed in claim 12, further comprising a vent in fluid communication with the clearance seal between the multiple orifices and the evacuation space.

14. A vacuum pump assembly as claimed in claim 13, wherein the vent and multiple orifices are located in the cylinder.

15. A vacuum pump assembly as claimed in claim 12 wherein two coaxial rows of multiple orifices are located within the cylinder to provide fluid communication from the gas source to the clearance seal.

16. A vacuum pump assembly as claimed in claim 15, wherein the orifices in each row are evenly spaced.

17. A vacuum pump assembly as claimed in claim 12 wherein two coaxial rows of multiple orifices are located within the piston to provide fluid communication from the gas source to the clearance seal.

18. A vacuum pump assembly as claimed in claim 12, wherein the piston assembly comprises a head portion supporting a ceramic liner and a body portion which supports convection fins.

19. A cryopump system having a roughing pump for initially evacuating a cryopump, the roughing pump comprising a piston assembly positioned for axial movement within a cylinder with an evacuation space at one end thereof and separated from the cylinder by an oil free clearance seal, a source of pressurized gas; said pressurized gas being supplied to the clearance seal to provide an air bearing.

20. A vacuum pump assembly as claimed in claim 19, further comprising:

(a) multiple orifices which provide fluid communication from the source of pressurized gas to the clearance seal.

21. A vacuum pump assembly as claimed in claim 20, further comprising a vent in fluid communication with the clearance seal between the multiple orifices and the evacuation space.

22. A vacuum pump assembly as claimed in claim 21, wherein the vent and the multiple orifices are located in the cylinder.

23. A vacuum pump assembly as claimed in claim 20, wherein two coaxial rows of multiple orifices are located within the cylinder to provide fluid communication from the gas source to the clearance seal.

24. A vacuum pump assembly as claimed in claim 23, wherein the orifices in each row are evenly spaced.

25. A vacuum pump assembly as claimed in claim 21 wherein the vent and multiple orifices are located in the piston.

26. A vacuum pump assembly as claimed in claim 19, wherein the piston assembly comprises a head portion supporting a ceramic liner and a body portion which supports convection fins.

* * * * *